US009566593B2

(12) United States Patent
Marty et al.

(10) Patent No.: US 9,566,593 B2
(45) Date of Patent: Feb. 14, 2017

(54) HAND SHOWER

(75) Inventors: Garry R. Marty, Fishers, IN (US); Timothy J. Sailors, Jr., Westfield, IN (US); Stephen C. Nichols, Plano, TX (US)

(73) Assignee: Delta Faucet Company, Indianapolis, IN (US)

( * ) Notice: Subject to any disclaimer, the term of this patent is extended or adjusted under 35 U.S.C. 154(b) by 991 days.

(21) Appl. No.: 13/346,208

(22) Filed: Jan. 9, 2012

(65) Prior Publication Data

US 2012/0266376 A1 Oct. 25, 2012

Related U.S. Application Data

(63) Continuation-in-part of application No. 29/390,013, filed on Apr. 19, 2011, now Pat. No. Des. 652,108, and a continuation-in-part of application No. 29/390,027, filed on Apr. 19, 2011, now Pat. No. Des. 652,109, and a continuation-in-part of application No. 29/390,028, filed on Apr. 19, 2011, now Pat. No. Des. 652,110, and a continuation-in-part of application No. 29/390,031, filed on Apr. 19, 2011, now Pat. No. Des. 652,894.

(51) Int. Cl.

| | |
|---|---|
| ***A47K 3/00*** | (2006.01) |
| ***B05B 1/18*** | (2006.01) |
| ***B05B 15/06*** | (2006.01) |

(52) U.S. Cl.

CPC ..... *B05B 1/185* (2013.01); *B05B 15/066* (2013.01); *B05B 15/069* (2013.01)

(58) Field of Classification Search

USPC ..... 4/615; 239/391, 393, 394, 395, 437, 239/587.6, 538

See application file for complete search history.

(56) References Cited

U.S. PATENT DOCUMENTS

| | | | | |
|---|---|---|---|---|
| D228,908 | S | 10/1973 | Juhlin | |
| 3,830,432 | A * | 8/1974 | Grohe | 239/394 |
| 4,122,845 | A | 10/1978 | Stouffer et al. | |

(Continued)

FOREIGN PATENT DOCUMENTS

| | | | |
|---|---|---|---|
| CN | 2748743 | Y | 12/2005 |
| CN | 101163838 | A | 4/2008 |

(Continued)

OTHER PUBLICATIONS

Kohler Flipside™, "Turning showering on its head," 2010, printed from http://www.us.kohler.com/performanceshowers/handshowers, 1 page.

(Continued)

*Primary Examiner* — Lauren Crane

(74) *Attorney, Agent, or Firm* — Faegre Baker Daniels LLP

(57) ABSTRACT

A hand shower including a handle with a first waterway including an inlet portion and an outlet portion, the inlet portion configured to be fluidly coupled to a water supply. A shower head includes a second waterway having an inlet portion and an outlet portion. The inlet portion of the second waterway is fluidly coupled to the outlet portion of the first waterway, and the outlet portion of the second waterway includes a plurality of outlets configured to deliver water. The shower head is supported for rotation about a longitudinal axis of the handle between a first position and a second position angularly spaced from the first position.

33 Claims, 12 Drawing Sheets

(56) References Cited

U.S. PATENT DOCUMENTS

| | | | | |
|---|---|---|---|---|
| 4,151,955 | A | 5/1979 | Stouffer | |
| 4,340,177 | A * | 7/1982 | Huber | 239/242 |
| 4,398,664 | A | 8/1983 | Stouffer | |
| 4,403,735 | A | 9/1983 | Weaver | |
| 5,213,267 | A | 5/1993 | Heimann et al. | |
| 5,297,739 | A | 3/1994 | Allen | |
| 6,007,002 | A | 12/1999 | Huber | |
| 6,328,228 | B1 | 12/2001 | Bossini | |
| 6,360,965 | B1 | 3/2002 | Clearman et al. | |
| 6,502,796 | B1 | 1/2003 | Wales | |
| D495,028 | S | 8/2004 | Jorgensen et al. | |
| 7,111,800 | B2 | 9/2006 | Berning et al. | |
| D529,986 | S | 10/2006 | Chan | |
| D555,229 | S | 11/2007 | Wrobleski et al. | |
| D557,766 | S | 12/2007 | Hoernig et al. | |
| 7,360,723 | B2 | 4/2008 | Lev | |
| D575,845 | S | 8/2008 | Lobermeier et al. | |
| D578,181 | S | 10/2008 | Pan | |
| 7,546,646 | B2 * | 6/2009 | Shien | 4/615 |
| 7,578,453 | B1 | 8/2009 | Wilson | |
| D599,883 | S | 9/2009 | Tippens | |
| D604,392 | S | 11/2009 | Schoenherr et al. | |
| 7,665,676 | B2 | 2/2010 | Lev | |
| 7,694,897 | B2 | 4/2010 | Bulan et al. | |
| 7,766,291 | B2 | 8/2010 | Eilmus et al. | |
| 7,770,820 | B2 | 8/2010 | Clearman et al. | |
| 7,770,825 | B2 | 8/2010 | Kajuch | |
| 7,775,456 | B2 | 8/2010 | Gopalan et al. | |
| D626,194 | S | 10/2010 | Kakihana et al. | |
| D633,174 | S | 2/2011 | Lee | |
| D652,108 | S | 1/2012 | Eads et al. | |
| D652,109 | S | 1/2012 | Nichols | |
| D652,110 | S | 1/2012 | Nichols | |
| D652,894 | S | 1/2012 | Nichols | |
| 8,640,973 | B2 * | 2/2014 | Gansebom | 239/390 |
| 2002/0074430 | A1 * | 6/2002 | Gransow | B05B 1/1618 239/397 |
| 2003/0041372 | A1 | 3/2003 | Yang | |
| 2004/0164189 | A1 | 8/2004 | Berning et al. | |
| 2005/0001072 | A1 | 1/2005 | Bolus et al. | |
| 2006/0138253 | A1 | 6/2006 | Petrovic et al. | |
| 2006/0219822 | A1 | 10/2006 | Miller et al. | |
| 2007/0158460 | A1 | 7/2007 | Lev | |
| 2007/0232108 | A1 | 10/2007 | Miura et al. | |
| 2007/0246577 | A1 | 10/2007 | Leber | |
| 2008/0073446 | A1 | 3/2008 | Zhou | |
| 2008/0272203 | A1 * | 11/2008 | Leber | 239/101 |
| 2009/0007330 | A1 | 1/2009 | Genord et al. | |
| 2009/0206180 | A1 * | 8/2009 | Wilson | B05B 1/1672 239/525 |
| 2010/0072307 | A1 | 3/2010 | Hester et al. | |
| 2011/0061692 | A1 | 3/2011 | Gopalan et al. | |
| 2013/0254985 | A1 | 10/2013 | Zhou et al. | |

FOREIGN PATENT DOCUMENTS

| | | |
|---|---|---|
| CN | 102069043 A | 5/2011 |
| EP | 1216756 A2 | 6/2002 |
| GB | 2431861 | 5/2007 |
| JP | 03845868 B1 | 11/2006 |
| WO | WO 2006/025875 | 3/2006 |
| WO | WO 2006/039987 | 4/2006 |
| WO | WO 2012/050894 | 4/2012 |

OTHER PUBLICATIONS

Kohler, "Flipside™ 01 multifunction handshower K-17493," printed Dec. 21, 2011 from http://www.us.kohler.com/onlinecatalog, 2 pages.

Kohler Faucets, "Flipside™ 01 Four-Function Handshower K-17493, also K-45425, features and installation notes," at least as early as Dec. 21, 2011, 2 pages.

* cited by examiner

HAND SHOWER

CROSS-REFERENCE TO RELATED APPLICATIONS

This patent application is a continuation-in-part of U.S. Design patent application Ser. No. 29/390,013, entitled "Handheld Shower," filed Apr. 19, 2011 now U.S. Pat. No. Des. 652,108, a continuation-in-part of U.S. Design patent application Ser. No. 29/390,027, entitled "Handheld Shower," filed Apr. 19, 2011 now U.S. Pat. No. Des. 652,109, a continuation-in-part of U.S. Design patent application Ser. No. 29/390,028, entitled "Handheld Shower," filed Apr. 19, 2011 now U.S. Pat. No. Des. 652,110, and a continuation-in-part of U.S. Design patent application Ser. No. 29/390,031, entitled "Handheld Shower," filed Apr. 19, 2011 now U.S Pat. No. Des. 652,894, the disclosures of which are expressly incorporated by reference herein.

BACKGROUND AND SUMMARY OF THE INVENTION

The present invention relates to hand showers and, more particularly, to a hand shower including a rotatable shower head.

A variety of fluid delivery devices are known for use within a shower or bathtub, including fixed overhead shower heads, wall-mounted body sprays, and hand showers. Hand showers, or handheld shower heads, are typically connected to a water supply through a flexible conduit thereby permitting the hand shower to be moved for directing water flow as desired by the user.

The present disclosure relates to a hand shower including a handle having a first waterway including an inlet portion and an outlet portion. The inlet portion is configured to be fluidly coupled to a water supply. A shower head includes a second waterway including an inlet portion and an outlet portion. The inlet portion of the second waterway is fluidly coupled to the outlet portion of the first waterway. The outlet portion of the second waterway includes a plurality of outlets configured to deliver water at an oblique angle relative to the handle. The inlet portion of the second waterway is rotatably coupled to the outlet portion of the first waterway, such that the shower head rotates about a longitudinal axis of the handle between a first position and a second position angularly spaced from the first position.

According to another illustrative embodiment of the present disclosure, a hand shower comprises a handle having a base portion and a connecting portion defining a longitudinal connector axis, and a shower head including a plurality of outlets configured to deliver water in a direction generally parallel to a water flow axis. A connector rotatably couples the shower head to the handle, wherein rotation of the shower head about the longitudinal connector axis alters the angular orientation of the water flow axis relative to the base portion of the handle.

According to a further illustrative embodiment of the present disclosure, a hand shower comprises a handle having a base portion and a connecting portion defining a longitudinal connector axis, and a shower head including a plurality of outlets configured to deliver water along a water flow axis. The shower head is operably coupled to the handle for rotation about the longitudinal connector axis between a first position and a second position angularly spaced from the first position. A detent device releasably secures the shower head in one of the first position and the second position.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1A:
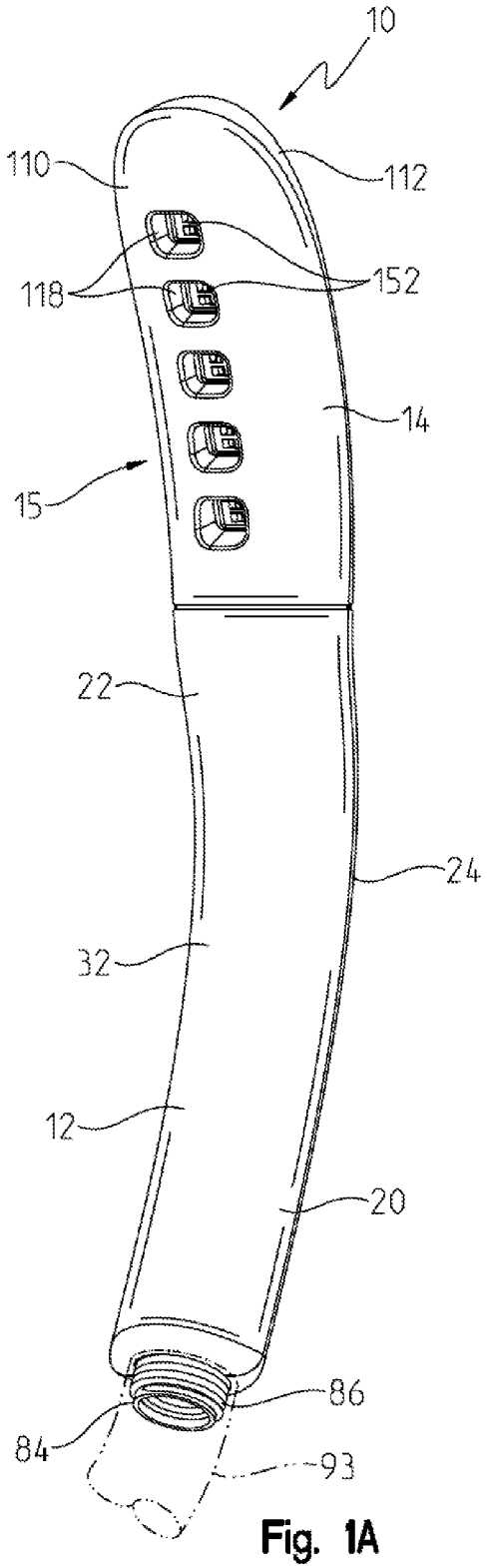
FIG. 1A is a front perspective view of an illustrative hand shower according to the present disclosure, showing the shower head in a first rotational position.
Figure 1B:
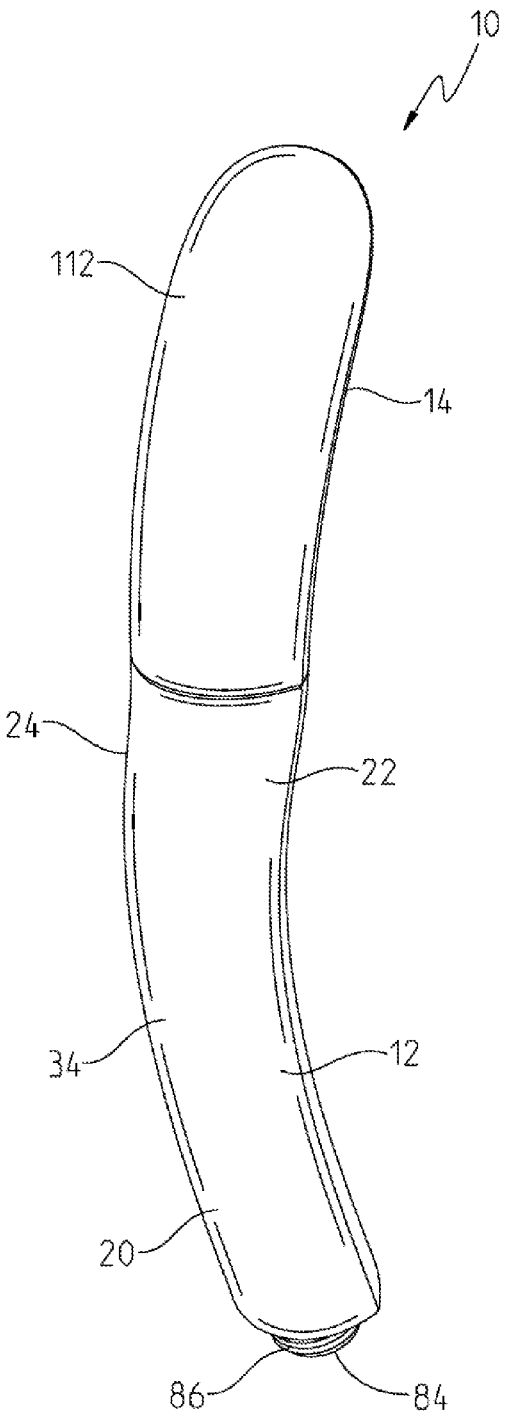
FIG. 1B is a rear perspective view of the hand shower of FIG. 1A.
Figure 1C:
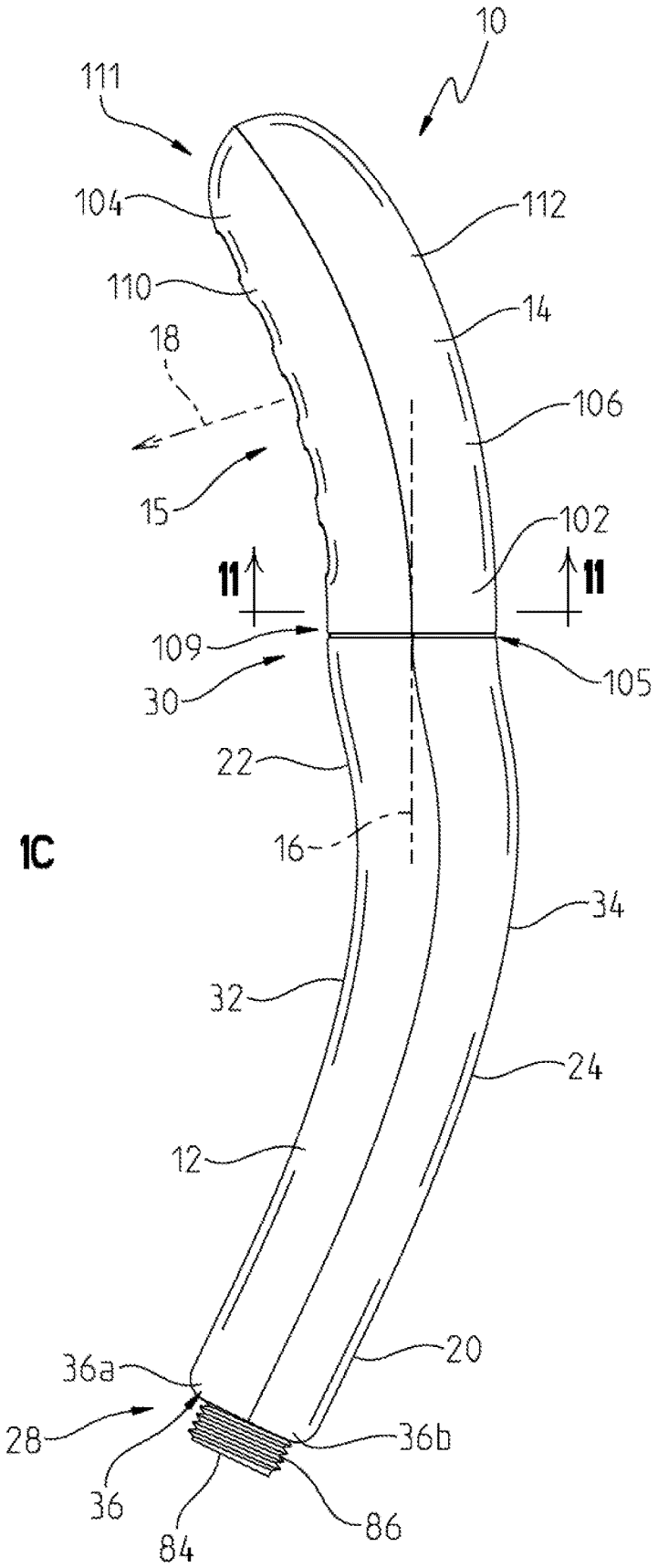
FIG. 1C is a side elevational view of the hand shower of FIG. 1A.

The embodiments of the invention described herein are not intended to be exhaustive or to limit the invention to precise forms disclosed. Rather, the embodiments selected for description have been chosen to enable one skilled in the art to practice the invention.

Referring initially to FIGS. 1A-4, an illustrative hand shower 10 is shown as including a handle 12 and an axially rotatable shower head 14 including a plurality of water outlets 15. More particularly, the shower head 14 is supported for rotation about a longitudinal connector axis 16 defined by the handle 12 (FIGS. 1C, 2C, 3, and 4). As further detailed herein, rotation of the shower head 14 may change the angle of water spray produced by the water outlets 15 relative to the handle 12 as desired. As further detailed herein, water exits from the water outlets 15 of the shower head 14 generally in the direction of a longitudinal water flow axis 18, wherein the angle between the longitudinal flow axis 18 and the handle 12 may change relative to the rotational position of the shower head 14.

With reference to FIGS. 1C, 2C, and 3-6, the handle 12 includes an inlet or base portion 20 and an outlet or connector portion 22. The base portion 20 is configured to be fluidly coupled to a water supply (not shown). The handle 12 illustratively further includes a cover or shell 24 which receives a first waterway 26. The shell 24 is illustratively curved as it extends longitudinally from opposing ends 28 and 30. The shell 24 may be defined by a front cover 32 and a rear cover 34. The front cover 32 and the rear cover 34 may be formed of a polymer, such as a thermoplastic, and secured together through conventional means, such as heat welding, adhesives, or fasteners. The front cover 32 and the rear cover 34 include arcuate end walls 36*a*, 36*b* and 38*a*, 38*b* that together define opposing end flanges 36 and 38 positioned at opposing ends 28 and 30 of the shell 24. The front cover 32 illustratively includes a plurality of strengthening ribs 40 positioned on an inner surface 42 and positioned intermediate the opposing ends 28 and 30.

With reference to FIGS. 3-6, the first waterway 26 illustratively includes a tube or conduit 44 including an inlet portion 46 and an outlet portion 48 extending between opposing ends 50 and 52. Illustratively, the conduit 44 is formed of a metal, such as brass. Alternatively, the conduit 44 may be formed of a molded polymer, such as a thermoplastic. The inlet portion 46 is received within the base portion 20 of the handle 12, while the outlet portion 48 is received within the connector portion 22 of the handle 12. More particularly, the inlet portion 46 is received between the front and rear covers 32 and 34 of the shell 24 and includes retaining tabs 54 and 56 that are received within slots 58 and 60 defined by ribs 62 and 64 supported by inner surfaces 42 and 66 of the front and rear covers 32 and 34, respectively. Similarly, the outlet portion 48 is received between the front and rear covers 32 and 34 of the shell 24 and includes retaining tabs 68 and 70 that are received within slots 72 and 74 defined by ribs 76 and 78 supported by inner surfaces 42 and 66 of the front and rear covers 32 and 34, respectively. The inlet portion 46 extends through an opening defined by end flange 36, while the outlet portion 48 extends through an opening defined by end flange 38.

Figure 3:
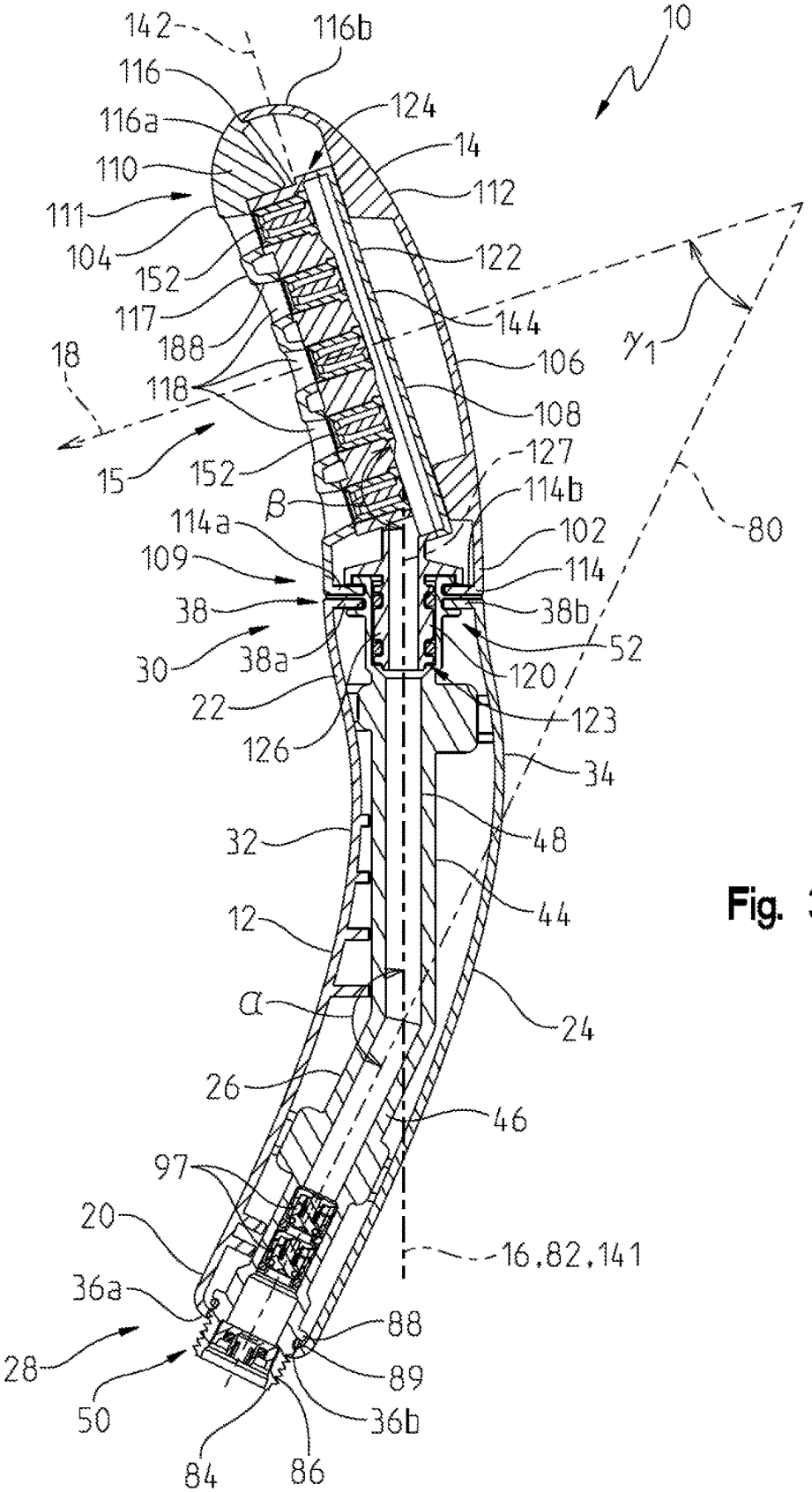
FIG. 3 is a longitudinal cross-sectional view of the hand shower of FIG. 1A.
Figure 4:
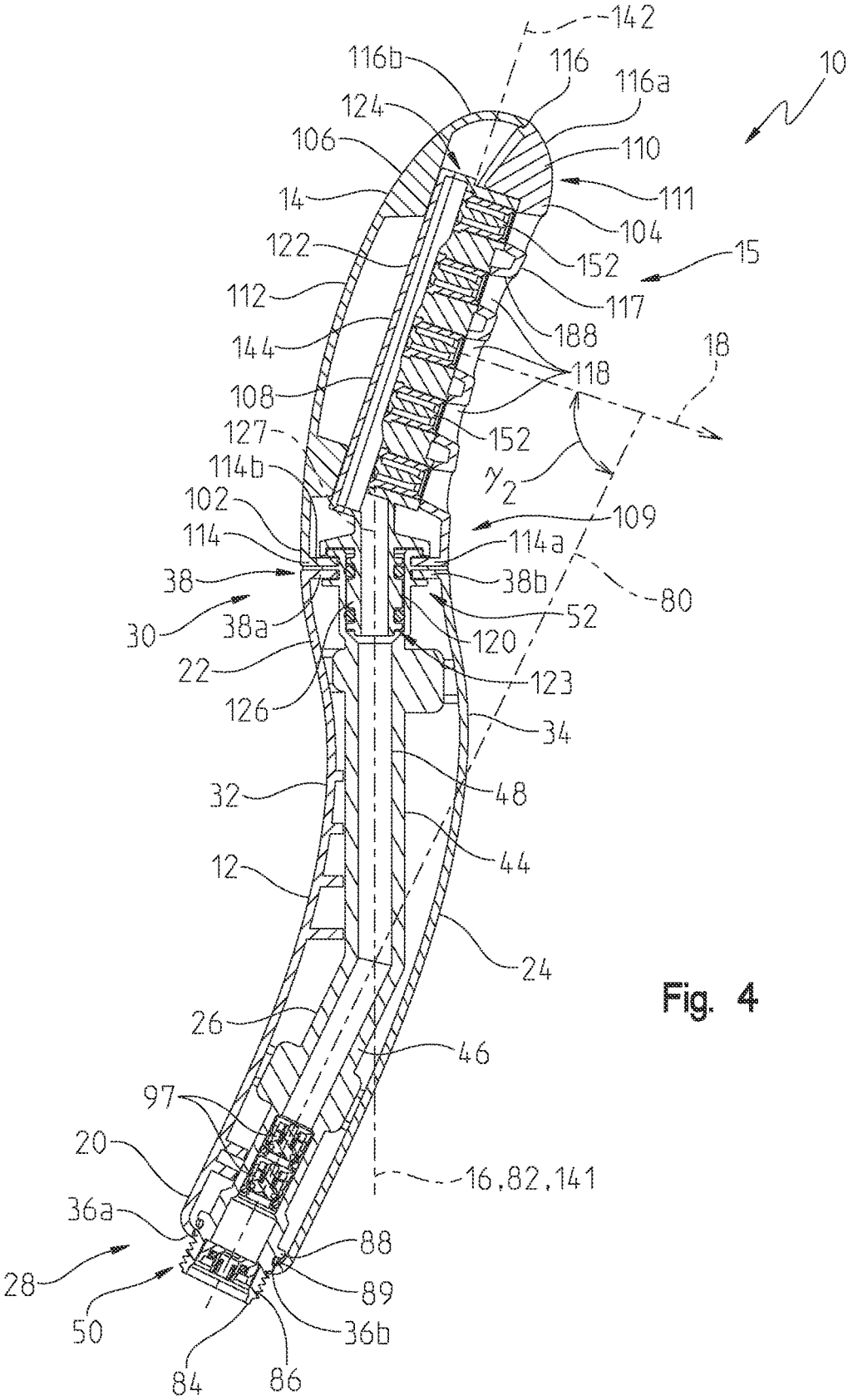
FIG. 4 is a longitudinal cross-sectional view similar to FIG. 3, showing the hand shower in the second rotational position of FIG. 2A.

With further reference to FIGS. 3 and 4, the inlet portion 46 of conduit 44 extends along a longitudinal inlet or base axis 80, while the outlet portion 48 of conduit 44 extends along a longitudinal outlet axis 82. Illustratively, the outlet axis 82 is coaxially aligned with the connector axis 16, while the inlet axis 80 is angled from the outlet axis 82 by an angle $\alpha$. In the illustrative embodiment, angle $\alpha$ is approximately 154 degrees (FIG. 3).

An external fluid coupling 84 is illustratively supported by the inlet end 50 of conduit 44. The fluid coupling 84 illustratively comprises a plurality of external threads 86 formed within the inlet portion 46 and is configured to fluidly couple with an external flexible hose or conduit 93 (FIGS. 1A and 2A) for providing water from the external water supply (not shown).

Figure 9:
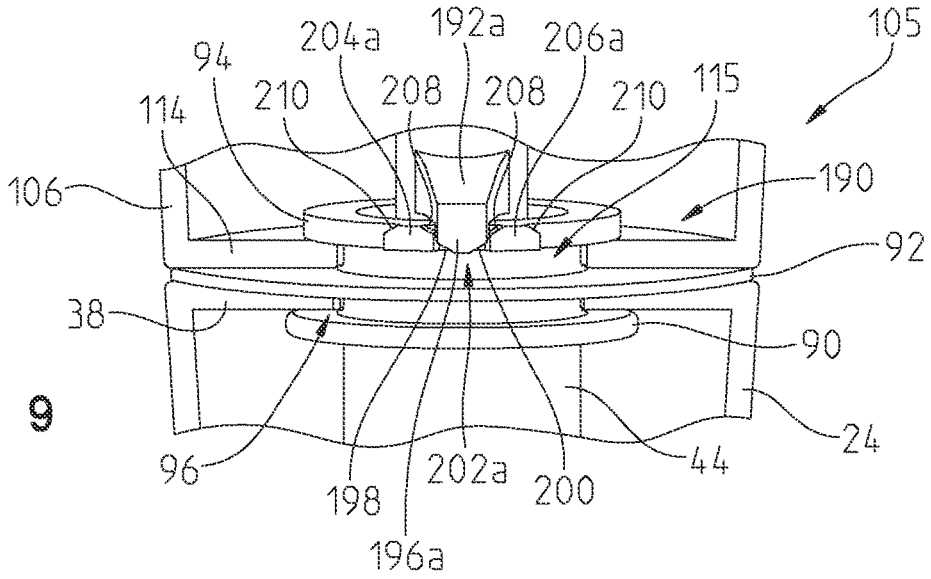
FIG. 9 is a detailed perspective view of the interface between the handle and shower head of the hand shower of FIG. 1A.

An external flange 88 extends radially outwardly from the conduit 44 proximate the inlet end 50. An o-ring 89 may be received radially around the inlet portion 46 of the conduit 44 and received axially intermediate flange 88 of the conduit 44 and the end flange 36 of the shell 24. Axially spaced external flanges 90, 92, and 94 extend radially outwardly from the conduit 44 proximate the outlet end 52. The end flange 38 of shell 24 is received within a groove 96 defined intermediate flanges 90 and 92 of conduit 44 (FIGS. 3, 4, and 9). As such, the conduit 44 is secured to the shell 24.

Check valves 97 of conventional design may be received within the inlet portion 46 of the conduit 44. Similarly, a flow restrictor 98 also of conventional design may be received within the inlet portion 46 of the conduit 44.

Figure 2A:
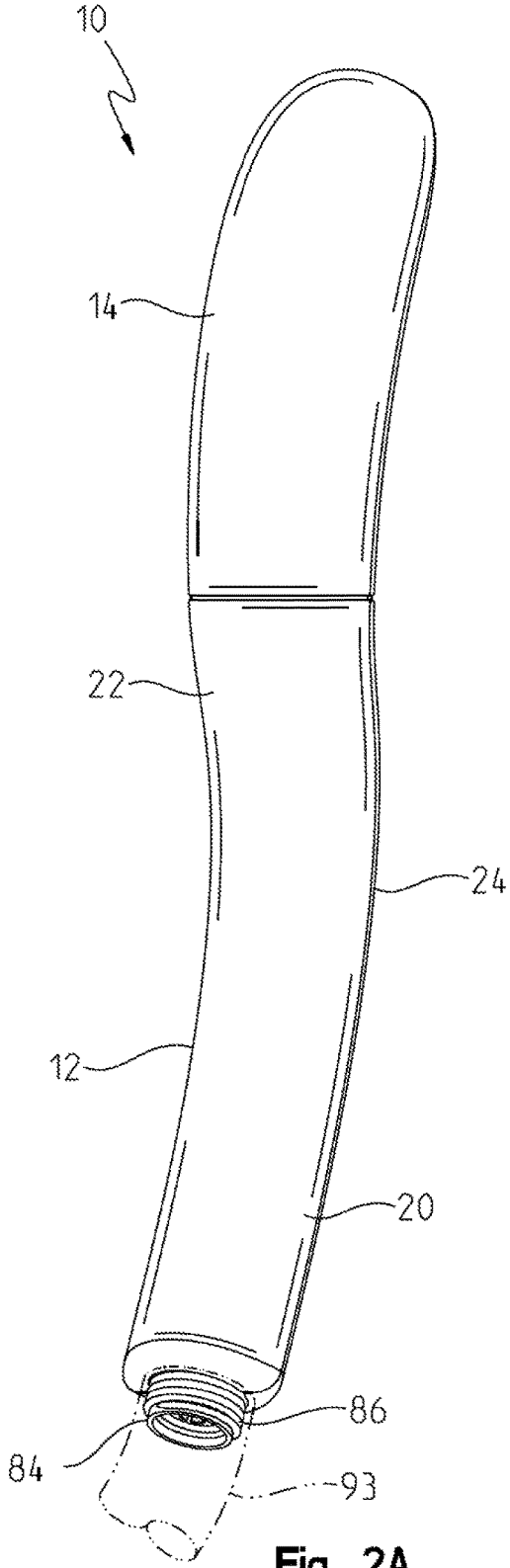
FIG. 2A is a front perspective view of the hand shower if FIG. 1A, showing the shower head rotated 180 degrees to a second rotational position.
Figure 2B:
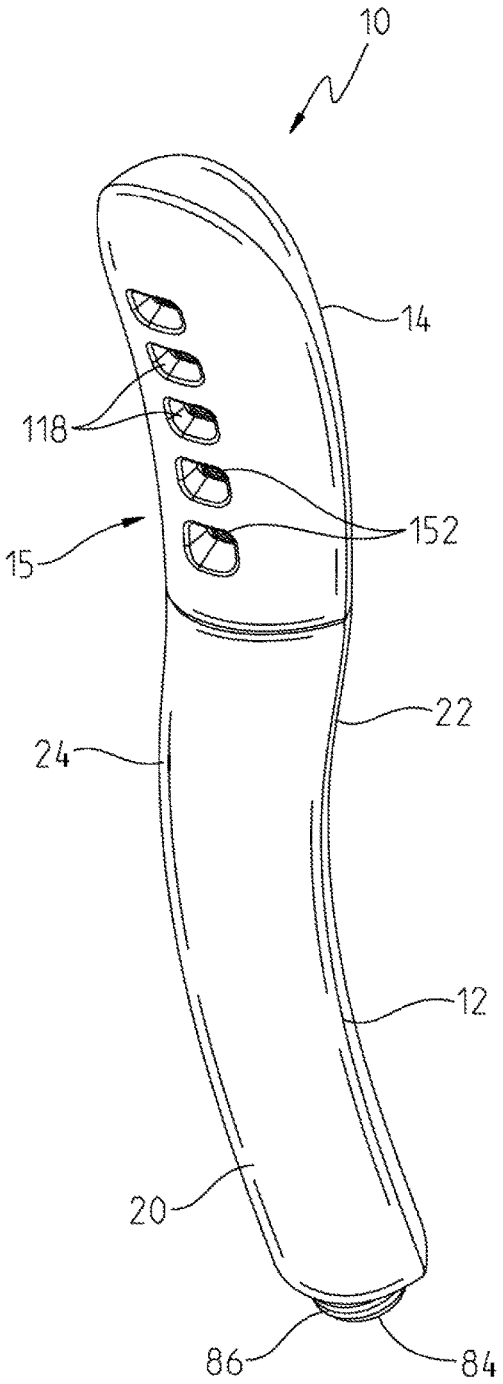
FIG. 2B is a rear perspective view of the hand shower of FIG. 2A.
Figure 2C:
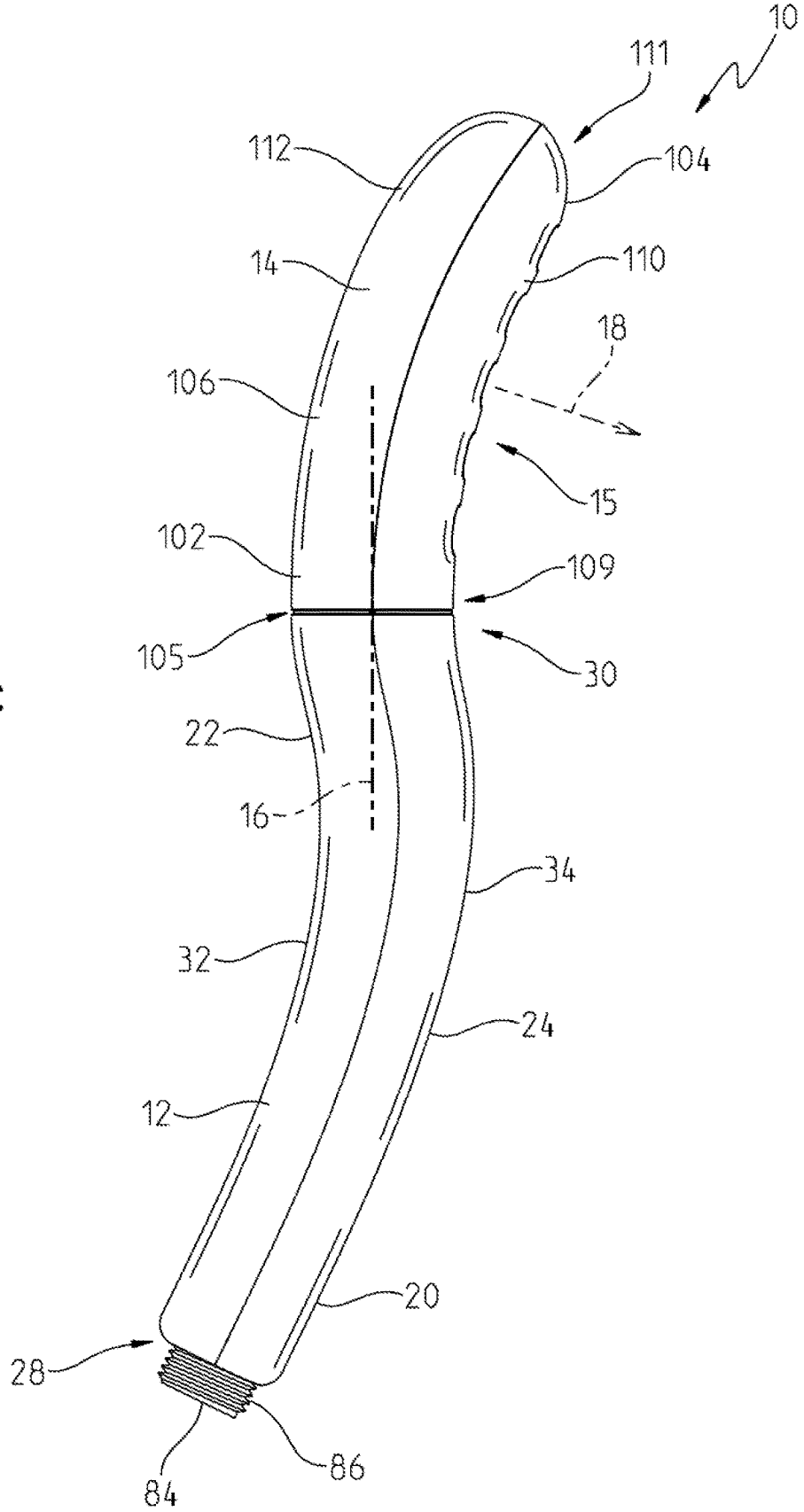
FIG. 2C is a side perspective view of the hand shower of FIG. 2A.

With reference to FIGS. 1C, 2C, and 3-6, the shower head 14 includes an inlet or connector portion 102 and an outlet portion 104. A connector 105 rotatably couples the inlet portion 102 of the shower head 14 to the outlet portion 22 of the handle 12. The shower head 14 illustratively further includes a shell 106 which receives a second waterway 108. The shell 106 is illustratively curved as it extends longitudinally from opposing ends 109 and 111 and may conform to the curvature of the shell 24 of the handle 12 to define a substantially continuous curved outer surface. In the illustrative embodiment, the side elevation defined by the shells 24 and 106 defines a C-shape in a first orientation (FIGS. 1C and 3) and an S-shape in a second orientation (FIGS. 2C and. 4). It should be appreciated that other shapes may also be defined by the shells 24 and 106 of the handle 12 and the shower head 14, respectively.

The shell 106 may be defined by a front cover 110 and a rear cover 112. The front cover 110 and the rear cover 112 may be formed of a polymer, such as a thermoplastic, and secured together through conventional means, such as heat welding, adhesives, or fasteners. The front cover 110 and the rear cover 112 include arcuate end walls 114*a*, 114*b* and 116*a*, 116*b*. End walls 114*a* and 114*b* together define an open end wall or end flange 114 defining an opening to receive the first and second waterways 26 and 108. End walls 116*a* and 116*b* together define a closed end 116. The end flange 114 of shell 106 is received within a groove 115 defined intermediate flanges 92 and 94 of conduit 44 of first waterway 26 (FIGS. 3, 4, and 9).

The front cover 110 includes a spray face 117 having a plurality of openings 118 aligned with the water outlets 15. In the illustrative embodiment, five (5) openings 118 are provided in a linear arrangement. It should be appreciated that the number and arrangement of openings 118 and corresponding water outlets 15 may vary.

The second waterway 108 illustratively includes an inlet portion 120 and an outlet portion 122 extending between opposing ends 123 and 124. Illustratively, the second waterway 108 is formed of a molded polymer, such as a thermoplastic. Alternatively, the second waterway 108 may be formed of a metal, such as brass. The inlet portion 120 of the second waterway 108 is received within the inlet portion 102 of the shower head 14, and the outlet portion 122 of the second waterway 108 is received within the outlet portion 104 of the shower head 14.

Figure 10:
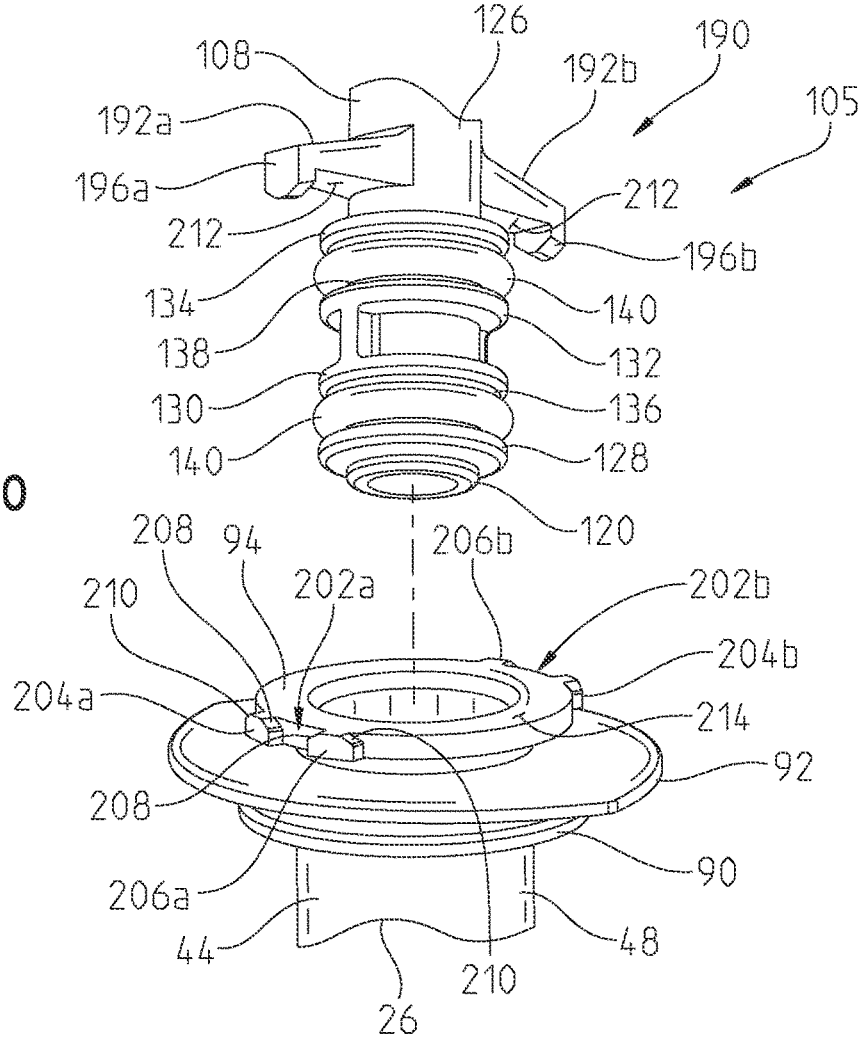
FIG. 10 is a detailed exploded perspective view of the interface of FIG. 9.

The inlet portion 120 of the second waterway 108 illustratively comprises a tube or conduit 126 extending along a longitudinal inlet axis 127 that is coaxially aligned with the connector axis 16. The conduit 126 extends outwardly through end flange 114 of shell 106 and is illustratively rotatably received within the outlet portion 48 of the first waterway conduit 44. Axially spaced flanges 128, 130, 132, and 134 extend radially outwardly from the inlet portion 120 and define grooves 136 and 138 (FIG. 10). O-rings 140 are illustratively received within grooves 136 and 138 and provide a fluid seal between the inlet portion 120 of the second waterway 108 and the outlet portion 48 of the first waterway 26.

With reference to FIGS. 3 and 4, the inlet portion 120 of the second waterway 108 extends along a longitudinal inlet axis 141, while the outlet portion 122 of the second waterway 108 extends along a longitudinal outlet axis 142. Illustratively, the inlet axis 141 is coaxially aligned with the connector axis 16, while the inlet axis 141 is angled from the outlet axis 142 by an angle β. In the illustrative embodiment, angle β is equal to approximately 162 degrees (FIG. 3).

Figure 5:
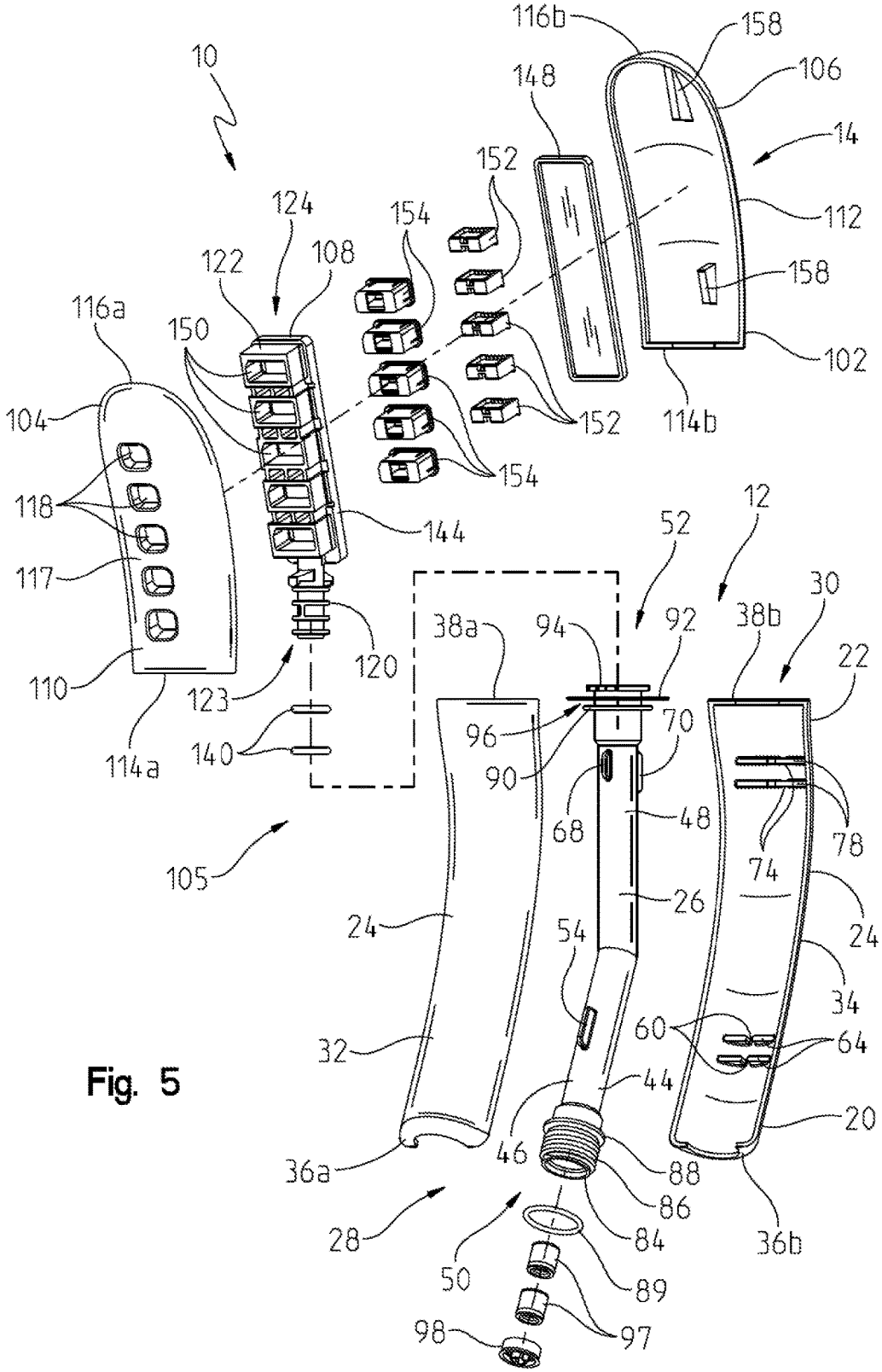
FIG. 5 is a front exploded perspective view of the hand shower of FIG. 1A.
Figure 6:
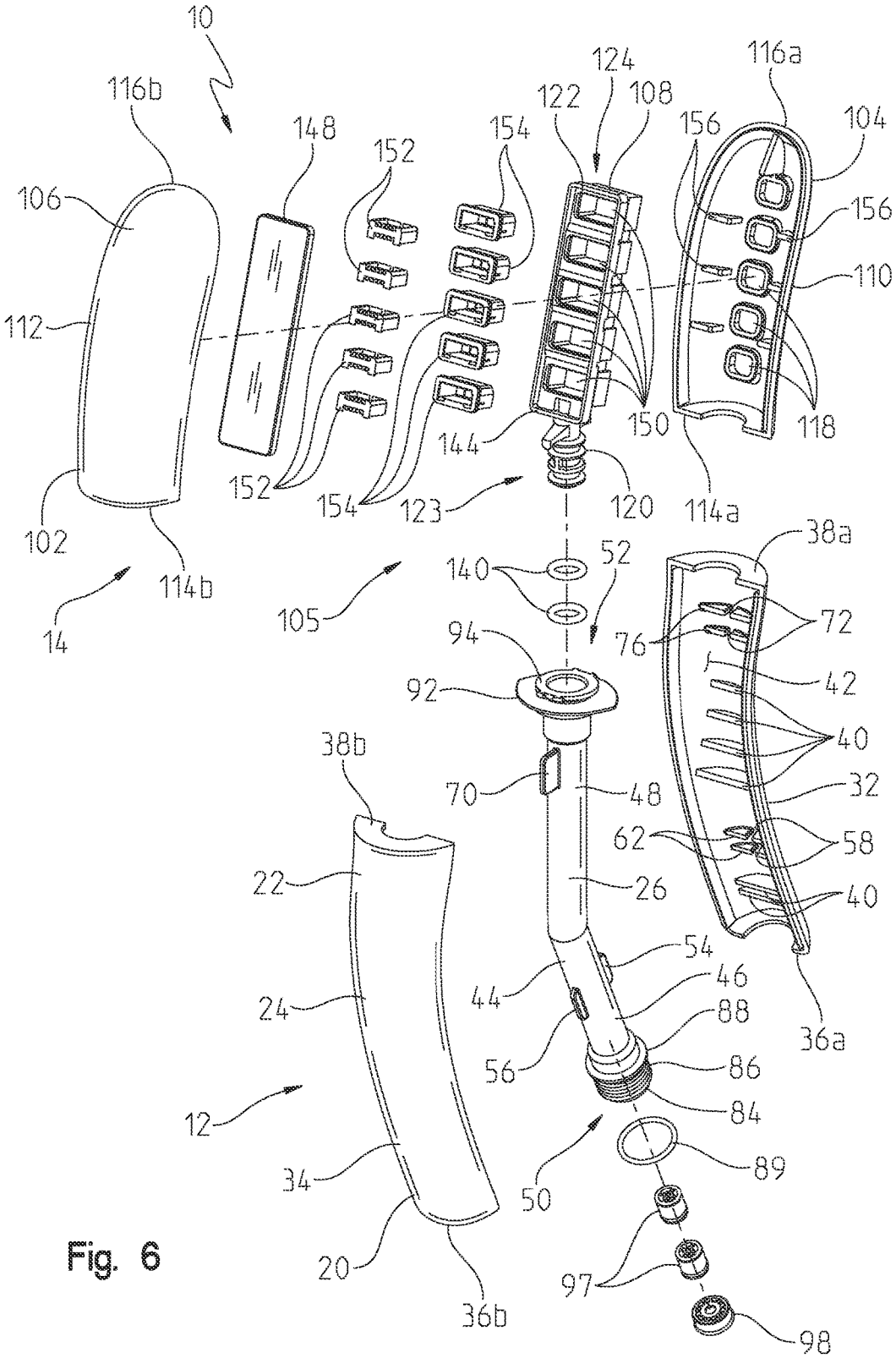
FIG. 6 is a rear exploded perspective view of the hand shower of FIG. 1A.

With reference to FIGS. 5 and 6, the outlet portion 104 of the second waterway 108 includes a housing or manifold 144 and a rear cover 148 coupled to the manifold 144. A plurality of receiving chambers 150 are formed within the front portion 146 and are configured to support a plurality of multi-dimensional fluid dispensers or fluidic devices 152. As further detailed herein, each multi-dimensional fluidic device 152 is configured to produce a stream or jet of water moving in at least two dimensions. Each fluidic device 152 is illustratively received within a housing 154 which, in turn, is received within one of the chambers 150 formed in the front portion 146. Illustratively, the fluidic devices 152 are dimensioned to be press fit within the housings 154, and the housings 154 are dimensioned to be press fit within the chambers 150. The housings 154 may also be ultrasonically welded to the chambers 150. Dimensional tolerances of the housings 154 may be more easily controlled than those of the plurality of chambers 150 of the second waterway 108.

A plurality of tabs 156 and 158 are supported by the front and rear covers 110 and 112, respectively. The tabs 156 and 158 provide clamping surfaces to engage and secure the second waterway 108 within the shell 106.

The fluidic devices 152 define the plurality of outlets 15 configured to deliver water at an oblique angle relative to the handle 12. More particularly, the fluidic devices 152 are configured to deliver water generally along longitudinal flow axis 18, which is disposed at an angle relative to the base axis 80 of the handle 12. The angle is oblique (i.e., not a right angle or a multiple of a right angle). As further detailed herein, the angle may vary as the shower head 14 is rotated about the connector axis 16.

Figure 7:
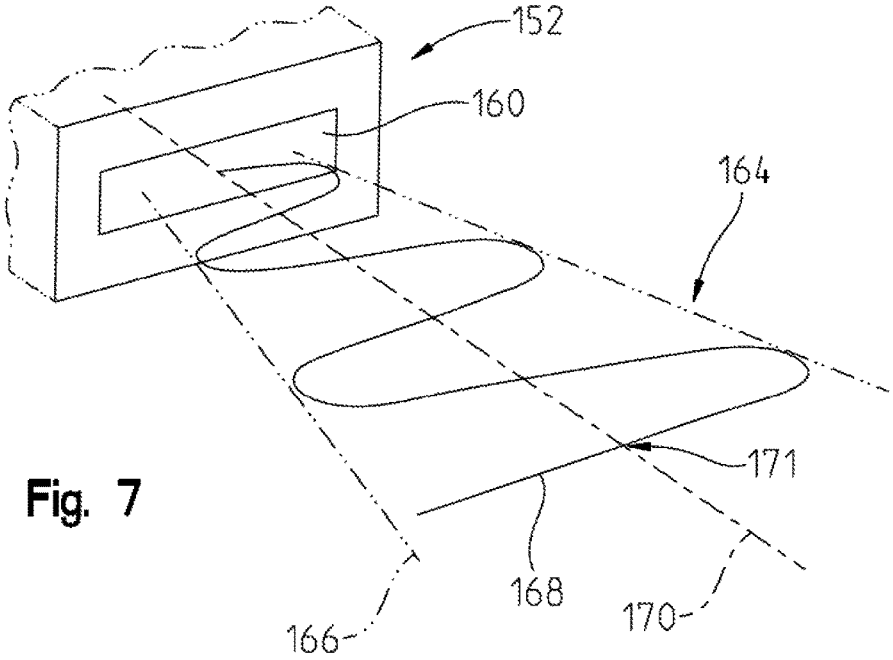
FIG. 7 is a perspective view in partial schematic of the water dispensed by a two-dimensional fluidic device of the present disclosure.
Figure 8A:
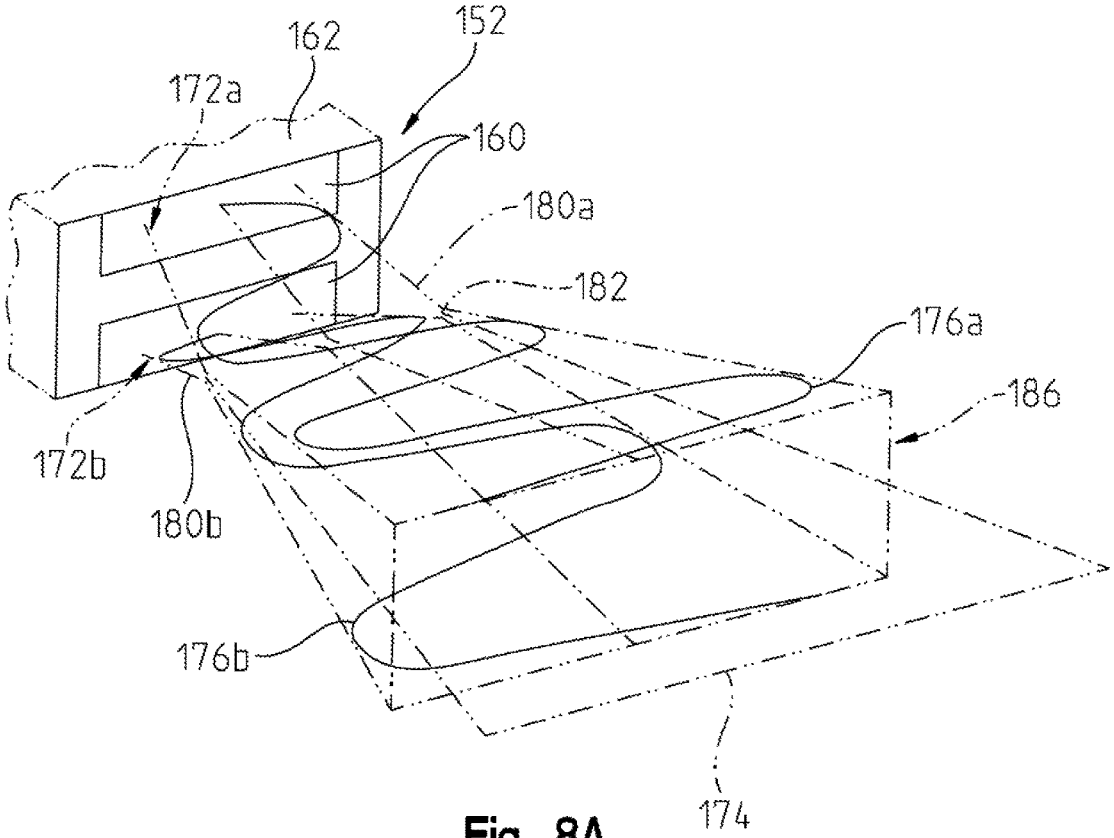
FIG. 8A is a perspective view in partial schematic of the water dispensed by a three-dimensional fluidic device of the present disclosure.
Figure 8B:
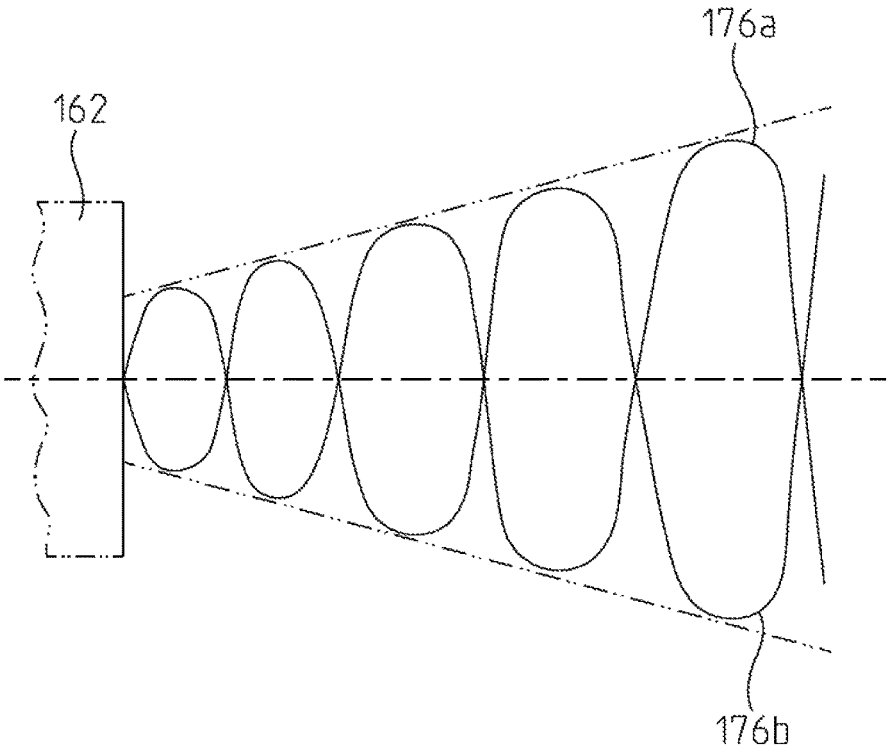
FIG. 8B is a top plan view in partial schematic of the water dispensed by the three-dimensional fluidic device of FIG. 8A.
Figure 8C:
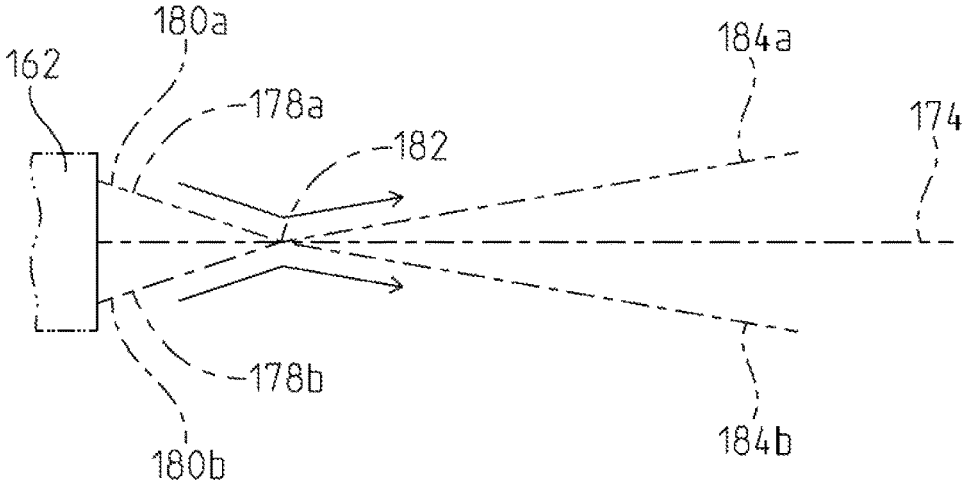
FIG. 8C is a side elevational view in partial schematic of the water dispensed by the three-dimensional fluidic device of FIG. 8A.

The fluidic devices 152 may comprise two-dimensional (2-D) or three-dimensional (3-D) fluidic devices or nozzles for providing multi-dimensional water spray patterns. With reference to FIG. 7, 2-D fluidic devices or nozzles 160 are configured to produce a fan of water 164 within a plane 166 by oscillating a water stream 168 about a center axis 170. The resulting spray 171 is illustratively a line in cross-section.

With reference to FIGS. 8A-8C, 3-D fluidic devices or nozzles 162 are configured to produce a pair of interacting fans of water 172*a*, 172*b*. In general, each 3-D fluidic device 162 comprises a pair of adjacent 2-D fluidic devices 160 disposed parallel to each other. Moreover, the 3-D effect may be produced by combining two 2-D fluidic devices 160 that have initially converging fans of water 172*a*, 172*b* that upon contact proximate a center plane 174 reflect outwardly away from each other. Illustratively, the fans of water 172*a*, 172*b* are formed by oscillating water streams 176*a*, 176*b* about a respective center axis 178*a*, 178*b* within initially converging planes 180*a*, 180*b*. At convergence point 182, the fans of water 172*a*, 172*b* reflect away from each other in diverging planes 184*a*, 184*b*, thereby moving in a direction away from center plane 174. The resulting spray 186 illustratively defines a rectangular cross-section. Illustratively, the fluidic devices 152 may be of the type manufactured by Bowles Fluidics Corporation of Columbia, Md., USA. Additional details on multi-dimensional fluidic chips are provided in PCT International Application No. PCT/US2011/053699, entitled "Showerhead with Multi-Dimensional Fluid Dispensers," filed Sep. 28, 2011, the disclosure of which is incorporated by reference herein.

Adequate clearance is provided by the spray face 117 to prevent the oscillating spray 186 from interfering therewith. More particularly, adequate clearance is provided by angled surfaces 188 formed within edges of openings 118 (FIGS. 3 and 4).

As described above, the inlet portion 120 of the second waterway 108 is rotatably coupled to the outlet portion 102 of the first waterway 26, such that the shower head 14 rotates about longitudinal connector axis 16 of the handle 12 between a first position (FIGS. 1A-1C and 3) and a second position (FIGS. 2A-2C and 4) angularly spaced from the first position. In the illustrated embodiment, the second position is angularly spaced from the first position by 180 degrees. As such, the water outlets 15 face toward the front of the hand shower 10 in the first position, and the water outlets 15 face toward the rear of the hand shower 10 in the second position. While two positions offset by 180 degrees are shown in the illustrative embodiment, it should be appreciated that the shower head 14 may be rotated to any number of different positions having different angular orientations.

The plurality of outlets 15 of the shower head 14 illustratively deliver water at a first oblique angle γ1 relative to the handle 12 toward a first, illustratively front, side of the hand shower 10 when the shower head 14 is in the first position. The plurality of outlets 15 of the shower head 14 illustratively deliver water at a second oblique angle γ2 relative to the handle 12 toward a second, illustratively a rear, side of the hand shower 10 when the shower head 14 is in the second position. The angles γ1 and γ2 are measured between the inlet axis 80 of the handle 12 and the water flow axis 18. The first oblique angle γ1 is different from the second oblique angle γ2. In the illustrative embodiment, the first oblique angle γ1 is approximately 46 degrees, while the second oblique angle γ2 is approximately 82 degrees. It should be appreciated that angles γ1 and γ2 may vary based upon different values of angles α and β of the first and second waterways 26 and 108, respectively.

Figure 11:
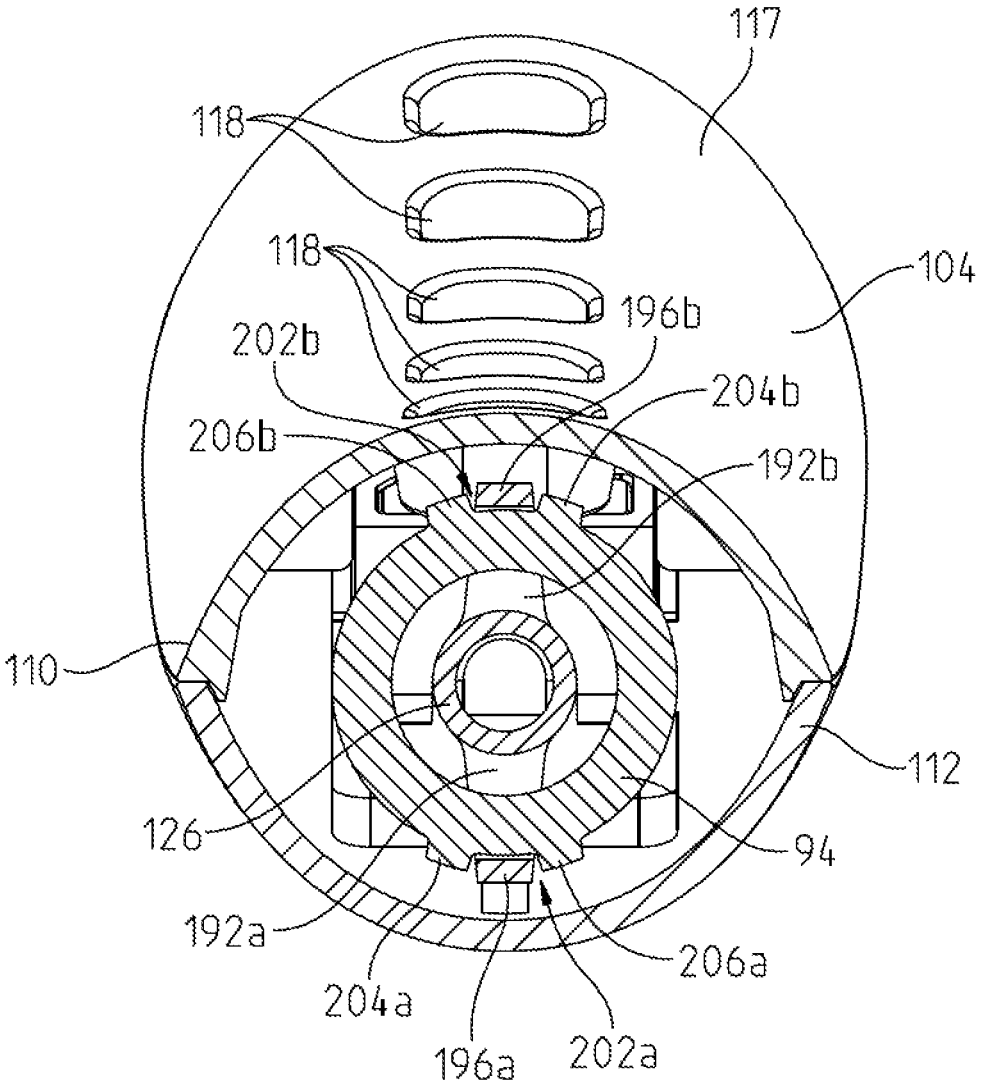
FIG. 11 is a cross-sectional view taken along line 11-11 of FIG. 1C.

With reference to FIGS. 9-11, the connector 105 includes a detent device 190 that acts as an indexing detent for releasably securing the shower head 14 in one of the first position and the second position. The detent device 190 illustratively includes first and second cantilevered arms 192*a* and 192*b* extending radially outwardly from the second waterway 108. As further detailed herein, flange 92 extends radially outwardly from the first waterway 26. Cantilevered arms 192*a* and 192*b* include free ends supporting locking tabs 196*a* and 196*b*, respectively. Each locking tab 196 includes inclined surfaces 198 and 200.

The flange 94 of first waterway 26 supports a first recess 202*a* and a second recess 202*b* associated with the first and second positions of the shower head 14. Each recess 202*a*, 202*b* is illustratively defined by a pair of opposing radially extending retaining members 204*a*, 206*a*, and 204*b*, 206*b*, respectively. Each retaining member 204, 206 includes inner and outer inclined surfaces 208 and 210 configured to cooperate with the inclined surfaces 198, 200 of the locking tabs 196.

The first locking tab 196*a* is received within the first recess 202*a*, and the second locking tab 196*b* is received within the second recess 202*b* to releasably secure the shower head 14 in the first position. Rotation of the shower head 14 by 180 degrees around the connector axis 16 results in the second locking tab 196*b* being received with the first recess 202*a*, and the first locking tab 196*a* being received within the second recess 202*b* for releasably securing the shower head 14 in the second position.

The cantilevered arms 192*a* and 192*b* are flexible such that the free ends supporting locking tabs 196*a* and 196*b* may move as force is applied thereto. As shown in FIG. 9, the shower head 14 is in a locked position. As the shower head 14 is rotated, the tabs 196*a*, 196*b* engage cooperating retaining members 204*a*, 206*a*. More particularly, clockwise rotation of the shower head 14 causes inclined surfaces 198 of locking tabs 196 to engage cooperating inner inclined surfaces 208 of the retaining members 204. Similarly, counterclockwise rotation of the shower head 14 causes inclined surfaces 200 of locking tabs 196 to engage cooperating inner inclined surfaces 208 of the retaining members 206.

Continued rotation of the shower head 14 forces the arms 192*a* , 192*b* to flex upwardly thereby allowing the tabs 196*a* , 196*b* to cam out of the cooperating receiving recesses 202*a* , 202*b* . Once the tabs 196*a* , 196*b* are disengaged from the accepting recesses 202*a* , 202*b* , the shower head 14 is free to rotate until the tabs 196*a* , 196*b* engage the opposing retaining members 204, 206.

More particularly, as the shower head 14 is rotated clockwise from the front side to the rear side of the hand shower 10, the inclined surfaces 198 of locking tabs 196 engage cooperating outer inclined surfaces 210 of the opposite retaining members 206. Similarly, if the shower head 14 is rotated counterclockwise from the front side to the rear side of the hand shower 10, the inclined surfaces 200 of locking tabs 196 engage cooperating outer inclined surfaces 210 of the opposite retaining members 204.

Continued rotation of the shower head 14 forces the tabs 196*a*, 196*b* to engage the retaining members 204, 206 forcing the arms 192*a*, 192*b* upwardly. Continued rotation allows the tabs 196 to engage with the recesses 202, thereby locking the shower head 14 in position. This provides an audible click to the user.

A tactile feel may also be provided to the user as the shower head 14 is rotated. Lower surfaces 212 of the cantilevered arms 192 ride on an upper surface 214 of the waterway flange 94 with a biasing force created by an interference between the arms 192 and waterway flange 94 (FIG. 10). More particularly, lower surfaces 212 of the arms 192 are biased toward and movably engage upper surface 214 of the flange 94, thereby acting as a friction brake or clutch and providing a tactile feel to the user as the shower head 14 is rotated between the first and second positions. The detent provided by the raised tabs 196 engaging in the recesses 202 may also provide for a visual aspect of the proper orientation of the shower head 14 in one of the first and second positions.

As detailed herein, the illustrative detent device 190 provides a positive position indication to the user of rotational position of the shower head 14 relative to the handle 12. Such user indication may include tactile, visual, and audible aspects.

With reference to FIG. 9, to provide retention and stability for the rotating shower head 14, end flange 38 on the handle shell 24 engages with groove 96 on the first waterway 26. Similarly, end flange 114 on the shower head shell 106 engages into molded groove 115 on the first waterway 26 to lock the assembly together and provide stability. Wear flange 92 is formed as a part of the first waterway 26 and is sandwiched between the handle shell 24 and the mating shower head shell 106. The front cover 32 and the rear cover 34 of handle shell 24, and the front cover 110 and the rear cover 112 of the shower head shell 106 may then be snapped, riveted, threaded or held together in a variety of known manners.

In operation, water is supplied through the flexible hose 93 to the inlet portion 46 of the first waterway 26, past the flow restrictor 98 and check valves 97, and into the connecting portion 48 of the first waterway 26. Water is supplied through the connector 105 and into the inlet portion 120 of the second waterway 108 within the shower head 14. In the first rotational position of FIGS. 1A-1C and 3, water is delivered from the fluidic devices 152 generally in the direction of the water flow axis 18. As shown in FIG. 3, the water flow axis 18 is illustratively angled relative to the base axis 80 by angle γ1. The detent device 190 releasably secures the shower head 14 in the first rotational position. More particularly, the tabs 196 of the cantilever arms 192 are received within cooperating recesses 202.

By rotating the shower head 14, either clockwise or counter-clockwise, the cantilevered arms 192 are flexed away from the flange 94 by camming action of the inclined surfaces 208 against the cooperating inclined surfaces 198, 200 of the tabs 196. The shower head 14 may then be further rotated about connector axis 16 to the second position (e.g., 180 degrees from the first position) where the tabs 196 are received within diametrically opposed recesses 202. As the tabs 196 approach the recesses 202, they are flexed away from the flange 94 by the inclined surfaces 210 of the associated retaining members 206. The tabs 196 then drop into the recesses 202 to illustratively provide an audible click, tactile feel, and visual indication to the user. In the second rotational position of FIGS. 2A-2C and 4, water is delivered from the fluidic devices 152 generally in the direction of water flow axis 18 opposite of the water flow in the first position. In this second position, the water flow axis 18 is illustratively angled relative to the base axis by angle γ2.

Although the invention has been described in detail with reference to certain preferred embodiments, variations and modifications exist within the spirit and scope of the invention as described and defined in the following claims.

The invention claimed is:

1. A hand shower comprising:

a handle including a first waterway including an inlet portion defining a longitudinal inlet axis and an outlet portion defining a longitudinal outlet axis angled relative to the longitudinal inlet axis, the inlet portion configured to be fluidly coupled to a water supply;

a shower head including a second waterway including an inlet portion and an outlet portion extending along a longitudinal outlet axis in a generally vertical direction, the inlet portion of the shower head fluidly coupled to the outlet portion of the first waterway, and the outlet portion of the shower head including a plurality of outlets defining a water flow axis for delivering water at an oblique angle relative to the longitudinal inlet axis of the handle;

wherein the inlet portion of the second waterway is rotatably coupled to the outlet portion of the first waterway, such that the shower head rotates about the longitudinal outlet axis of the handle between a first position and a second position angularly spaced by 180 degrees from the first position; and wherein the plurality of outlets of the shower head define the water flow axis at a first oblique angle relative to the handle toward a front side of the longitudinal inlet axis of the hand shower and the water flow axis extends toward the inlet portion of the shower head when the shower head is in the first position, and the plurality of outlets of the shower head define the water flow axis at a second oblique angle relative to the handle toward a rear side of the longitudinal inlet axis of the hand shower and the water flow axis extends toward the inlet portion of the shower head when the shower head is in the second position, the first oblique angle being different from the second oblique angle.

2. The hand shower of claim 1, wherein the outlet portion of the first waterway is coaxially aligned with the inlet portion of the second waterway.

3. The hand shower of claim 2, wherein the inlet portion of the first waterway is angled relative to the outlet portion of the first waterway, and the inlet portion of the second waterway is angled relative to the outlet portion of the second waterway.

4. The hand shower of claim 2, wherein one of the outlet portion of the first waterway and the inlet portion of the second waterway is concentrically received within the other of the inlet portion of the second waterway and the outlet portion of the first waterway.

5. The hand shower of claim 1, further comprising a detent device to releasably secure the shower head in one of the first position and the second position.

6. The hand shower of claim 3, wherein the detent device includes a cantilevered arm extending radially outwardly from one of the first waterway and the second waterway, and a flange extending radially outwardly from the other of the first waterway and the second waterway, the cantilevered arm supporting a locking tab and the flange supporting a first recess and a second recess, the locking tab received within the first recess to releasably secure the shower head in the first position, and the locking tab received within the second recess to releasably secure the shower head in the second position.

7. The hand shower of claim 6, wherein a lower surface of the cantilevered arm is biased toward and rides on an upper surface of the flange to provide a tactile feel to the user as the shower head is rotated.

8. The hand shower of claim 1, wherein:

the handle includes a first outer shell receiving the first waterway;

the shower head includes a second outer shell receiving the second waterway; and a first groove and a second groove axially spaced from the first groove are supported by at least one of the first waterway and the second waterway, wherein a lip of the first outer shell is retained within the first groove and a lip of the second outer shell is retained within the second groove.

9. The hand shower of claim 8, further comprising a wear flange positioned intermediate the first outer shell and the second outer shell.

10. The hand shower of claim 1, wherein the outlets are defined by a plurality of fluidic devices configured to oscillate water about a center axis.

11. The hand shower of claim 1, wherein:

the handle includes a first outer shell receiving the first waterway;

the shower head includes a second outer shell receiving the second waterway; and the first and second outer shells are contoured to together define a C-shape when the spray head is in the first position and define an S-shape when the spray head is in the second position.

12. A hand shower comprising:

a handle including a base portion defining a longitudinal base axis and a connecting portion defining a longitudinal connector axis angled relative to the longitudinal base axis;

a shower head including an inlet portion, an outlet portion, a waterway defining a longitudinal outlet axis, and a plurality of outlets defining a water flow axis for delivering water in a direction generally parallel to the water flow axis;

a connector rotatably coupling the shower head to the handle, such that the shower head rotates about the longitudinal connector axis of the handle between a first position and a second position angularly spaced by 180 degrees from the first position, wherein rotation of the shower head about the longitudinal connector axis alters the angular orientation of the water flow axis relative to the base portion of the handle; and wherein the plurality of outlets of the shower head define the water flow axis at a first oblique angle relative to the handle toward a front side of the longitudinal inlet axis of the hand shower and the water flow axis extends toward the inlet portion of the shower head when the shower head is in the first position, and the plurality of outlets of the shower head define the water flow axis at a second oblique angle relative to the handle toward a rear side of the longitudinal inlet axis of the hand shower and the water flow axis extends toward the inlet portion of the shower head when the shower head is in the second position, the first oblique angle being different from the second oblique angle.

13. The hand shower of claim 12, wherein:

the handle includes a first waterway including an inlet portion and an outlet portion, the inlet portion configured to be fluidly coupled to a water supply;

the shower head includes a second waterway including an inlet portion and an outlet portion, the inlet portion fluidly coupled to the outlet portion of the first waterway; and the inlet portion of the second waterway is rotatably coupled to the outlet portion of the first waterway, such that the shower head rotates about the longitudinal connector axis of the handle between a first position and a second position.

14. The hand shower of claim 13, wherein the outlet portion of the first waterway is coaxially aligned with the inlet portion of the second waterway.

15. The hand shower of claim 14, wherein the inlet portion of the first waterway is angled relative to the outlet portion of the first waterway, and the inlet portion of the second waterway is angled relative to the outlet portion of the second waterway.

16. The hand shower of claim 13, wherein one of the outlet portion of the first waterway and the inlet portion of the second waterway is concentrically received within the other of the inlet portion of the second waterway and the outlet portion of the first waterway.

17. The hand shower of claim 13, further comprising a detent device to releasably secure the shower head in one of the first position and the second position.

18. The hand shower of claim 17, wherein the detent device includes a cantilevered arm extending radially outwardly from one of the first waterway and the second waterway, and a flange extending radially outwardly from the other of the first waterway and the second waterway, the cantilevered arm supporting a locking tab and the flange supporting a first recess and a second recess, the locking tab received within the first recess to releasably secure the shower head in the first position, and the locking tab received within the second recess to releasably secure the shower head in the second position.

19. The hand shower of claim 18, wherein a lower surface of the cantilevered arm is biased toward and rides on an upper surface of the flange to provide a tactile feel to the user as the shower head is rotated.

20. The hand shower of claim 13, wherein:

the handle includes a first outer shell receiving the first waterway;

the shower head includes a second outer shell receiving the second waterway;

a first groove and a second groove spaced from the second groove are supported by at least one of the first waterway and the second waterway, wherein a lip of the first outer shell is retained within the first groove and a lip of the second outer shell is retained within the second groove.

21. The hand shower of claim 20, further comprising a wear flange positioned intermediate the first outer shell and the second outer shell.

22. The hand shower of claim 12, wherein the outlets are defined by a plurality of fluidic devices configured to oscillate water about a center axis.

23. The hand shower of claim 12, wherein:

the handle includes a first outer shell;

the shower head includes a second outer shell; and the first and second outer shells are contoured to together define a C-shape when the spray head is in the first position and define an S-shape when the spray head is in the second position.

24. A hand shower comprising:

a handle including a base portion defining a longitudinal base axis and a connecting portion defining a longitudinal connector axis angled relative to the longitudinal base axis;

a shower head including an inlet portion, an outlet portion, and a plurality of outlets configured to deliver water along a water flow axis, the shower head operably coupled to the handle for rotation about the longitudinal connector axis between a first position and a second position angularly spaced from the first position;

a detent device to releasably secure the shower head in one of the first position and the second position;

wherein the detent device includes a locking tab configured to be received within a first recess to prevent rotation of the showerhead relative to the handle from the first position, and configured to be received within a second recess to prevent rotation of the showerhead relative to the handles from the second position;

wherein rotation of the shower head about the longitudinal connector axis alters the angular orientation of the water flow along the water flow axis relative to the base portion of the handle;

wherein the second position is angularly spaced from the first position by 180 degrees; and wherein the plurality of outlets of the shower head deliver water along the water flow axis at a first oblique angle relative to the base portion of the handle toward a front side of the hand shower and the water flow axis extends toward the inlet portion of the shower head when the shower head is in the first position, and the plurality of outlets of the shower head deliver water along the water flow axis at a second oblique angle relative to the base portion of the handle toward a rear side of the hand shower and the water flow axis extends toward the inlet portion of the shower head when the shower head is in the second position, the first oblique angle being different from the second oblique angle.

25. The hand shower of claim 24, wherein:

the handle includes a first waterway including an inlet portion and an outlet portion, the inlet portion configured to be fluidly coupled to a water supply;

the shower head includes a second waterway including an inlet portion and an outlet portion, the inlet portion fluidly coupled to the outlet portion of the first waterway; and the inlet portion of the second waterway is rotatably coupled to the outlet portion of the first waterway, such that the shower head rotates about the longitudinal connector axis of the handle between the first position and the second position.

26. The hand shower of claim 25, wherein the inlet portion of the first waterway is angled relative to the outlet portion of the first waterway, and the inlet portion of the second waterway is angled relative to the outlet portion of the second waterway.

27. The hand shower of claim 25, wherein one of the outlet portion of the first waterway and the inlet portion of the second waterway is concentrically received within the other of the inlet portion of the second waterway and the outlet portion of the first waterway.

28. The hand shower of claim 25, wherein the detent device includes a cantilevered arm extending radially outwardly from one of the first waterway and the second waterway, and a flange extending radially outwardly from the other of the first waterway and the second waterway, the cantilevered arm supporting the locking tab and the flange supporting the first recess and the second recess, the locking tab received within the first recess to releasably secure the shower head in the first position, and the locking tab received within the second recess to releasably secure the shower head in the second position.

29. The hand shower of claim 28, wherein rotation of the spray head when in the first or second position, forces the cantilevered arm outwardly from the recess.

30. The hand shower of claim 28, wherein a lower surface of the cantilevered arm is biased toward and rides on an upper surface of the flange to provide a tactile feel to the user as the shower head is rotated.

31. The hand shower of claim 25, wherein:

the handle includes a first outer shell receiving the first waterway;

the shower head includes a second outer shell receiving the second waterway;

a first groove and a second groove spaced from the second groove are supported by at least one of the first waterway and the second waterway, wherein a lip of the first outer shell is retained within the first groove and a lip of the second outer shell is retained within the second groove.

32. The hand shower of claim 31, further comprising a wear flange positioned intermediate the first outer shell and the second outer shell.

33. The hand shower of claim 24, wherein the outlets are defined by a plurality of fluidic devices configured to oscillate water about a center axis.

* * * * *